United States Patent [19]

Thorneburg

[11] 4,277,959

[45] Jul. 14, 1981

[54] SOCKS WITH INTEGRALLY KNIT CUSHIONS IN HEEL, ARCH AND BALL

[76] Inventor: James L. Thorneburg, P.O. Box 5440, Statesville, N.C. 28677

[21] Appl. No.: 132,784

[22] Filed: Mar. 24, 1980

[51] Int. Cl.[3] ..... D04B 9/46; A41B 11/02

[52] U.S. Cl. ..... 66/182; 66/185; 66/187; 2/239

[58] Field of Search ..... 66/182, 171, 183, 185, 66/186, 187, 194, 191; 2/239; 36/10

[56] References Cited

U.S. PATENT DOCUMENTS

| | | | |
|---|---|---|---|
| 2,144,563 | 1/1939 | Davis | 66/185 X |
| 2,436,904 | 3/1948 | Shea | 66/186 X |
| 3,250,095 | 5/1966 | Bird | 66/194 X |
| 3,793,851 | 2/1974 | Thorneburg | 66/185 |
| 3,990,115 | 11/1976 | Nester | 2/239 |
| 4,194,249 | 3/1980 | Thorneburg | 2/239 |

*Primary Examiner*—Ronald Feldbaum

*Attorney, Agent, or Firm*—Bell, Seltzer, Park & Gibson

[57] ABSTRACT

The present athletic socks are particularly suitable for jogging and running and are provided with shock absorber cushion pads in the heel (11), ball (15), and in the inner portion (16*a*) of the arch area (16) and being formed by a sufficiently greater amount of yarn being knit in these portions than the amount of yarn knit in the outer portion of the arch (16*b*). The shock absorber cushion pads protect and cushion the heel, ball and inner portion of the arch of the wearer's foot and reduce the shock normally imparted to the heel, ball and inner portion of the arch of the foot so that normal articulation of the bones in the feet takes place when the wearer is jogging and running. The shock absorber cushion pads are illustrated as being formed by providing a greater density of terry loops in the heel (11), ball (15), and inner portion (16*a*) of the arch than in the outer portion (16*b*) of the arch to enhance the cushioning provided in the corresponding portions of each sock.

7 Claims, 8 Drawing Figures

SOCKS WITH INTEGRALLY KNIT CUSHIONS IN HEEL, ARCH AND BALL

FIELD OF THE INVENTION

This invention relates generally to athletic socks particularly suitable for jogging and running and more particularly to the provision of integrally knit terry loop shock absorber cushions in the heel and ball areas, as well as in the inner portion of the arch area of each sock of a pair of such socks so that the socks are "right" and "left" and adapted to fit the corresponding feet of the wearer. The outer portion of the arch area of each sock is provided with relatively less terry loop density than the terry loop density in the heel and ball areas and the inner portion of the arch area for enhancing the cushioning provided to the heel, ball and inner arch areas of the wearer's feet, and to provide additional support to the inner arch area of the wearer's feet.

BACKGROUND OF THE INVENTION

It has been the practice for many years to provide athletic type socks with a terry loop "cushion" sole in which the same type and density of terry loops extend throughout the length of the lower sole portion of the sock to provide the same type of terry loop cushioning, protection and moisture absorbency throughout the entire length and width of the lower portion of the foot of the wearer. When taking part in athletic activities, such as jogging and running, the cartilages joining the bones in the arch of the foot provide elasticity and the arch tends to flatten each time the foot impacts on the surface so that the arches begin to hurt after only a short period of jogging or running. Also, the known type of sock with the same type of terry loop cushioning throughout the length of the sole does not provide the required amount of terry loop density to absorb the shock applied against the corresponding heel and ball areas of the foot of the jogger or runner.

My co-pending application Ser. No. 12,072, filed Feb. 14, 1979, now U.S. Pat. No. 4,194,249, a jogging and running sock provided with terry loop shock absorber cushions in the heel and ball areas and with relatively less terry loop density in the arch area. The sock of said application cushions the shock of impact in the heel and ball areas of the wearer's feet, but does not provide the same type of cushioning in the inner arch areas of the wearer's feet.

My co-pending application Ser. No. 66,914, filed Aug. 16, 1979, discloses jogging and running socks with an integrally knit terry loop shock absorber cushion in the inner portion of the arch area of each sock of a pair of socks. The sock of said application cushions and supports the inner arch areas of the wearer's feet, but does not provide the same type of cushioning in the heel and ball areas of the wearer's feet.

SUMMARY OF THE INVENTION

With the foregoing in mind, it is an object of the present invention to provide athletic socks particularly suitable for jogging and running with an integrally knit terry loop shock absorber cushion in the inner portion of the arch areas of each sock for cushioning and supporting the arches of the wearer's feet and with integrally knit terry loop shock absorber cushions in the heel and ball areas. The outer portion of the arch areas of each sock is provided with a lesser amount of terry loop density so that the greater amount of terry loop density in the heel, ball and inner arch areas is more effective in cushioning and supporting the corresponding heel, ball and inner portions of the arches of the wearer's feet.

The additional cushioning in the heel, ball and inner arch areas of the socks of the present invention eliminates the need for separate heel, ball and arch pads because the shock absorber cushions are knit as an integral part of the inner portion of each sock. The greater amount of terry loop cushioning in the heel, ball and inner portions of the arch areas of the present socks provides the proper amount of cushioning and support of the bones of the feet in the normal and correct position so that relief is provided from discomfort incident to strains and pressures on the bones, ligaments, tissues, nerves and the cartilages joining the arch bones.

In the embodiment of the socks shown and described in the present application, the heel, ball and inner portion of the arch area of each sock is provided with first and second sets of terry loops knit of first and second terry yarns to provide a relatively heavy or dense cushioned area of greater terry loop density in the arch while a single terry yarn forms a single set of terry loops in the adjacent outer portion of the arch so that lesser terry loop density is provided in the outer portion of the arch area. This lesser terry loop density in the outer portion of the arch area enhances the additional cushioning and support provided to the corresponding heel, ball and inner arch areas of the wearer's feet.

The jogging and running socks of the present invention are illustrated as being of the type in which the cuff extends to a position just above the ankle. However, it is to be understood that the socks of the present invention may be of the low-cut type, or may be provided with a longer leg so that the cuff is positioned below or above the knee. The socks may be manufactured in these different styles for wear in different seasons of the year. Also, the prospective buyer is provided with several styles from which to choose, depending upon the particular preference of the buyer.

The provision of greater terry loop density in the heel, ball and inner portions of the arch area with lesser terry loop density in the adjacent outer portion of the arch insures that the full benefit of the terry loop shock absorber cushions in the heel, ball and inner portions of the arch area are available to be applied to the heel, ball and inner portions of the arches of the feet of the wearer. This type of shock absorbing cushioning is more effective than that provided in the presently available type of athletic socks in which the entire heel, arch and ball areas include the same type of terry loop cushioning throughout. With the same density of terry loops extending throughout the sole, the cushioned arch area supports and cushions both the inner and outer portions of the arch to the same degree as the heel and ball of the foot so that the inner portion of the arch does not receive the full benefit of the cushioning. On the other hand, the reduction, or elimination, of the terry loops in the outer portion of the arch area of each sock, in accordance with the present invention, provides greater terry loop density in the heel, ball and inner portion of the arch of each sock so that the support and cushioning in the arch area and the cushioning in the heel and ball areas is enhanced and the full benefit of the shock absorber cushions of greater terry loop density is provided in the heel, ball and inner arch areas of the wearer's feet.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
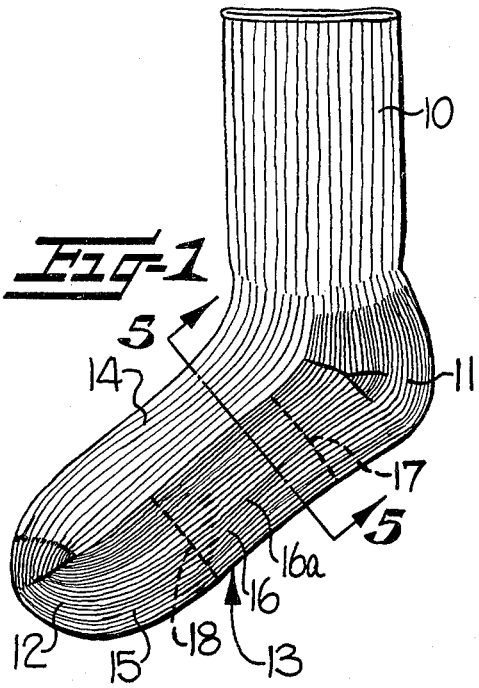
FIG. 1 is a side elevational view of one sock of the pair of socks of the present invention, the sock being shown in flattened condition and being adapted to be worn on the right foot.
Figure 2:
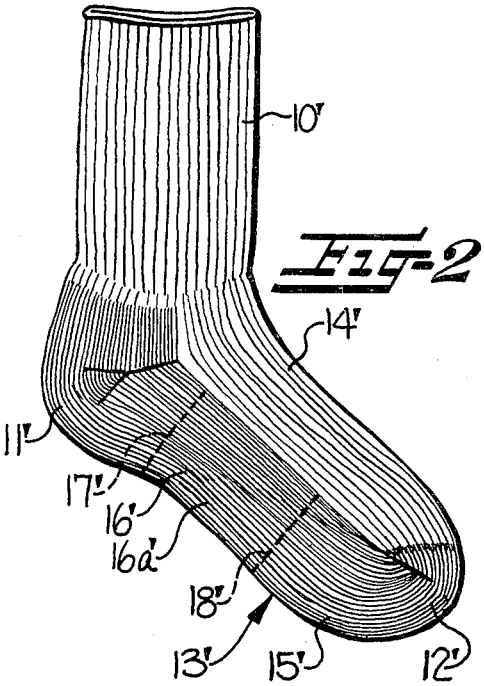
FIG. 2 is a view similar to FIG. 1 but illustrating a sock adapted to be worn on the left foot.

The socks illustrated in FIGS. 1–6 are of the type generally referred to as ankle length socks. The respective "right" and "left" socks of FIGS. 1 and 2 are the same except that the arch support shock absorber cushion pads are integrally knit on opposite sides or halves of the arch. The sock of FIG. 1 will be described in detail and the corresponding parts of the sock of FIG. 2 will bear the same reference characters with the prime notation added.

Generally, the sock (FIG. 1) includes a mock rib upper cuff 10 which is formed by knitting a body yarn while inlaying an elastic yarn in the usual manner. The foot of the sock includes a reciprocatorily knit heel area or pocket 11 provided with terry loops, formed in a manner to be presently described. The foot of the sock also includes a reciprocatorily knit toe portion or pocket 12, an integrally knit lower sole, broadly indicated at 13, which connects the heel pocket 11 and the toe pocket 12, and an upper instep 14. The sole 13 encompasses substantially one-half the lower circumference of the foot and the instep 14 encompasses substantially one-half the circumference of the upper portion of the foot.

Figure 3:
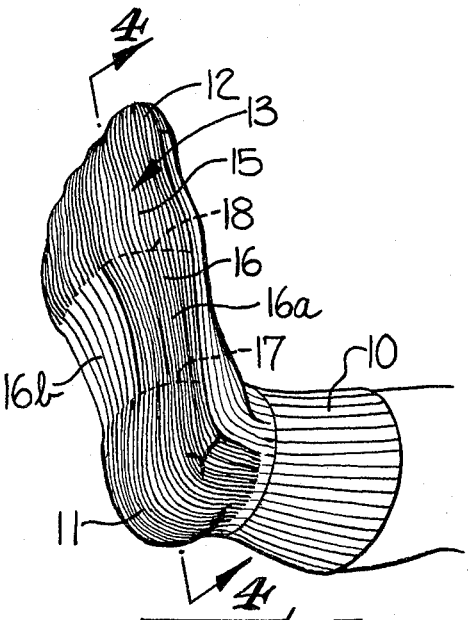
FIG. 3 is a perspective view of the "right" sock of FIG. 1, positioned on the foot and looking upwardly from beneath the foot.

The sole 13 includes a ball terry area 15 positioned adjacent to the toe pocket 12 and extending toward the heel pocket 11. The rear of the ball area 15 is integrally knit with the forward end of an arch terry area 16 extending throughout the sole 13 and from one side to the other of the instep 14. The arch terry area 16 is divided along the middle wale of the sole 13 to define an inner arch portion **16*a* and an outer arch portion 16*b* (FIG. 3). The inner and outer arch portions 16*a*, 16*b* are positioned on opposite sides of the sole 13 and extend coursewise from substantially the middle wale of the sole 13. The arch area 16 extends to a position closely adjacent the heel pocket 11 and is joined to the heel pocket 11** by a rotary knit interim portion.

Figure 5:
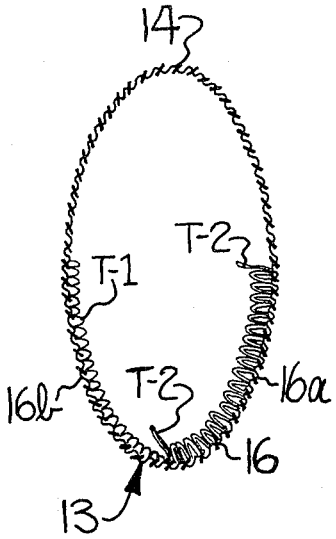
FIG. 5 is a schematic vertical sectional view taken along the line 5—5 in FIG. 1 and with the sock in partially opened condition.
Figure 6:
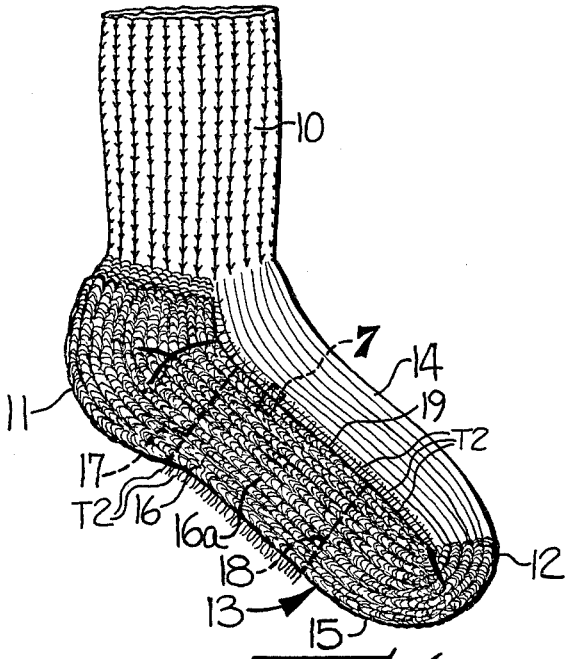
FIG. 6 is a view similar to FIG. 1 but illustrating the sock of FIG. 1 in everted condition with the terry loop areas facing outwardly.

As best shown in FIGS. 5 and 6, the heel 11 (and the rotary knit portions adjacent each side thereof), the ball 15, the toe 12, and inner portion **16*a* of the arch 16 are each provided with a relatively greater density of terry loops to form shock absorber cushion pads in these respective areas. On the other hand, the outer portion 16*b* of the arch 16 is provided with a relatively lesser density of terry loops, as illustrated in FIG. 5. The arch support shock absorber cushion pad is adapted to extend from about the middle of the bottom of the foot and up the side of the sole of the sock to cushion and protect the inner portion of the arch of the foot of the wearer (FIG. 6). The dotted lines 17, 18 (FIGS. 1, 2, 3 and 6) indicate the respective upper and lower ends of the inner portion 16*a* of the arch 16**.

Figure 7:
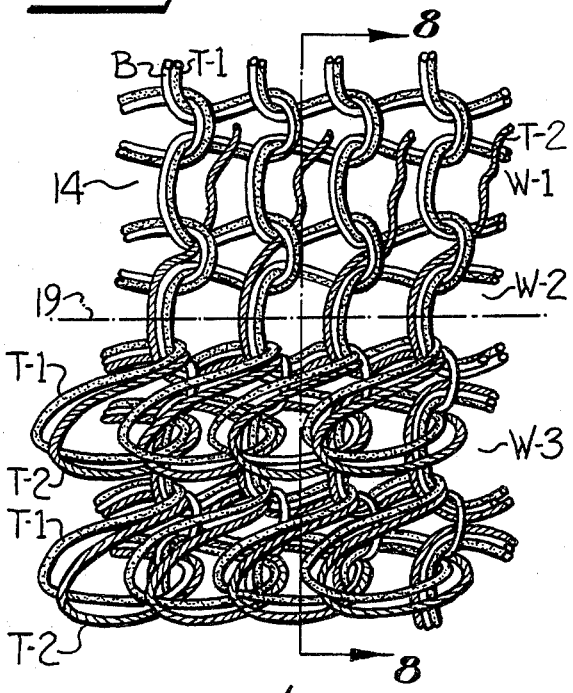
FIG.7 is a greatly enlarged elevational view of a small area of the knit fabric, being taken substantially in the dotted rectangle area 7 in FIG. 6, and illustrating the manner in which the first and second terry yarns form first and second sets of terry loops and are incorporated with the body yarn in the heel, ball and inner arch areas.
Figure 8:
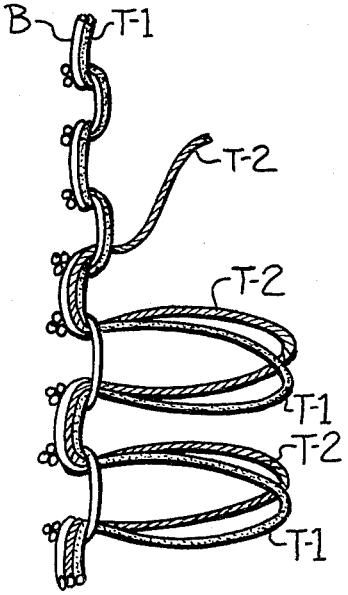
FIG. 8 is a vertical sectional view taken along the line 8—8 in FIG. 7 and illustrating the more dense or greater number of terry loops in the heel, ball and inner portions of the arch area.

The sock is knit throughout of one or more suitable body yarns, indicated in FIGS. 7 and 8 as a single plain yarn B. A first terry yarn, indicated at T-1 and speckled for identification, is knit with the body yarn B and forms a first set of terry loops throughout the heel 11, the area above the heel, the toe 12 and the sole 13. The successive courses of the knit fabric of FIGS. 7 and 8 extend in a vertical direction and the needle wales, indicated at W-1, W-2 and W-3, extend in a horizontal direction with the sinker wales, in which the terry loops are formed, aligned between the needle wales.

The first terry yarn T-1 is knit in plated relationship with the body yarn B in the needle wales and forms a first set of terry loops in the sinker wales in both the heel 11, toe 12, and sole 13 but is knit in plated relationship with the body yarn B in the sinker wales in the instep 14. Thus, the first terry yarn T-1 does not form terry loops in the instep 14, as illustrated between the needle wales W-1 and W-2 of FIG. 7.

A second terry yarn, indicated at T-2 and striped for identification in FIGS. 7 and 8, is knit with the body yarn B and forms a second set of terry loops in the inner portion **16*a* of the arch 16, as illustrated below the dash-dot line 19 in FIG. 7. The second terry yarn T-2 is fed to the needles through what is known as a "chopping" yarn feed finger and is fed to and removed and cut to form free ends adjacent opposite sides of the inner portion 16*a* of the arch 16, as illustrated in FIG. 8, so that the second terry yarn T-2 is not incorporated in the corresponding portion of the instep 14 and in the outer portion 16*b* of the arch 16**.

In the knit fabric shown in FIGS. 7 and 8, the body yarn B, the first terry yarn T-1 and the second terry yarn T-2 are illustrated as being of substantially the same size and the stitch structure is shown very open, for purposes of clarity. However, in the actual sock, the knit stitch loops contract and are very small and the terry yarns T-1 and T-2 are usually larger and bulkier than the body yarn B. The loose loops of the terry loops are free to relax so that the bulk in the yarn is developed, during finishing, and the terry loops are thicker, more dense and more crowded together than illustrated in FIGS. 7 and 8. Even when a single set of terry loops is formed in an area, such as the areas just below the cuff 10 in FIG. 6 and the outer portion 16*b* of the arch 16, a fairly dense compact cushion is formed. When the second set of terry loops is added, such as in the inner portion 16*a* of the arch 16, the terry loops are packed closer together and are more concentrated to form a much denser concentration of terry loops in the arch support cushion pad.

There are twice the number of terry loops formed in a given area of the inner portion 16*a* of the arch 16 as the number of terry loops formed in the outer portion 16*b* of the arch 16 so that the terry loop density in the inner portion 16*a* of the arch area 16 is greater than the terry loop density in the outer portion 16*b* of the arch 16. When an attempt is made to compress the terry loops in the inner portion 16*a* of the arch 16, which includes two sets of terry loops, there are so many terry loops packed into such a small area that they cannot lean over and flatten as easily as those areas where only a single set of terry loops is formed.

The first and second sets of terry loops are also formed in the area above the heel 11, the heel 11, the area following the heel 11, the inner portion 16*a* of the arch 16, the ball 15, and the toe 12 to form a support cushion pad C of greater terry loop density throughout these areas and provide a greater amount of cushioning or padding to these areas than the cushioning or padding in the outer portion of the arch of the foot of the wearer. The more dense terry loops forming the cushioning support pad extending throughout the sole 13, except in the outer portion 16*b* of the arch 16, and thus located where the greatest protection is needed for the heel, arch and ball when jogging and running.

Figure 4:
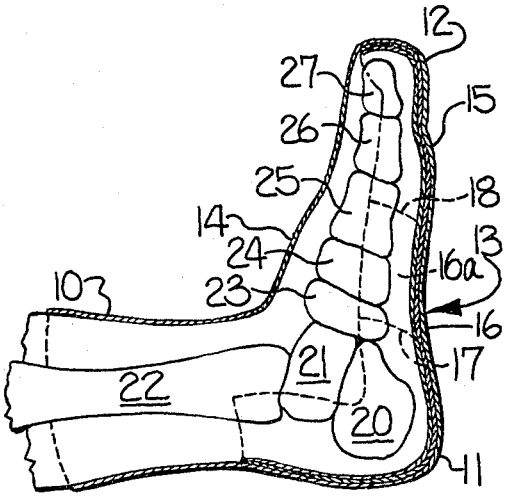
FIG. 4 is a longitudinal sectional view of the sock on the foot, being taken along the line 4—4 in FIG. 3 and showing the bones in the foot, and schematically illustrating the areas of additional or more dense terry loop cushioning or padding provided in the heel, ball, tow and inner portions of the arch area of the sock.

As shown in FIG. 4, the heel or calcaneus bone 20 is positioned beneath the talus bone 21 and at the lower end of the tibia 22. The other main bones in the foot include the navicular 23, the cuneiform 24, the metatarsals 25, the phalanges 26, and the toe bones 27. The more dense terry loops forming the cushioning support pad are positioned around the heel, beneath the inner portion of the arch (as indicated in dash-dot lines in FIG. 4), beneath the ball, and around the toes. When the foot impacts against the surface, the portion of the foot beneath the heel or calcaneus bone 20 is cushioned by the more dense terry loops therebeneath and the portion of the foot beneath the phalanges 26 is cushioned by the more dense terry loops therebeneath. At the same time, the bones in the arch, particularly the talus 21, the navicular 23, the cuneiform 24, and the upper ends of the metatarsals 25 are cushioned and supported by the more dense tery loops in the inner portion 16*a* of the arch 16.

While a particular embodiment of socks has been illustrated and described, it is to be understood that the illustrated embodiment may be varied, depending upon the particular need. For example, elastic yarn may be inlaid in the arch area 16 and the instep 14 of the socks to aid in maintaining the arch support cushion pad in the proper position against the inner portions of the arches of the feet of the wearer. The cushioning support pad of the present invention is preferably formed by first and second sets of terry loops, as illustrated and described. However, it is to be understood that the cushioning support pad can be formed by incorporating additional amounts of yarn by other known knitting techniques. In any event, a greater amount of yarn is knit in the heel, ball and inner arch portions than the amount of yarn knit in the outer arch portion. This greater amount of yarn provides increases thickness in the corresponding portions of the sock and decreased thickness in the outer arch portion so that the support and cushioning of the heel, ball and inner arch of the foot is enhanced and the normal articulation of the bones in the foot takes place when running and jogging.

In the drawings and specification there has been set forth a preferred embodiment of the invention, and although specific terms are employed, they are used in a generic and descriptive sense only and not for purposes of limitation, the scope of the invention being defined in the claims.

That which is claimed is:

1. A knit athletic sock for providing additional cushioning in the heel, ball and inner arch areas of a wearer's foot and particularly adapted for wear with athletic shoes having arch supports which fail to provide sufficient support and cushioning to prevent discomfort to the wearer's heel, ball and arch areas during participation in vigorous athletic activities such as jogging and running, said sock comprising a lower sole including a heel portion adjacent one end of said sole, an arch area in the medial portion of said sole, and a ball portion adjacent the other end of said sole, said arch area including inner and outer arch portions positioned on opposite sides of said sole and extending coursewise from substantially the middle wale of said sole, said inner arch portion including an onegrally knit shock absorber and support cushion formed by a sufficiently greater amount of yarn being knit in the inner arch portion than the amount of yarn being knit in said outer arch portion to provide increased thickness in the inner arch portion which is adapted to underlie the inner arch of the wearer's foot, said heel and said ball portions also including an integrally knit shock absorber cushion of the same types as said shock absorber and support cushion in said inner arch portion, said shock absorber cushions in said heel and ball areas enhancing the cushioning on the heel and ball of the wearer's foot, said shock absorber and support cushion in said inner arch portion enhancing the cushioning and support of the inner arch area of the wearer's foot, and thereby reducing the shock normally imparted to the wearer's foot so that normal acticulation of the bones in the foot takes place during participation in vigorous athletic activities.

2. A sock according to claim 1 wherein the greater amount of yarn in said heel, ball and inner arch portions is in the form of terry loops.

3. A sock according to claim 2 wherein said heel, ball and inner arch portions include first and second sets of terry loops.

4. A sock according to claims 2 or 3 wherein said outer arch portion includes a single set of terry loops.

5. A knit athletic sock for providing additional cushioning in the heel, ball and inner arch areas of a wearer's foot and particularly adapted for wear with athletic shoes having arch supports which fail to provide sufficient support and cushioning to prevent discomfort to the wearer's heel, ball and arch areas during participation in vigorous athletic activities such as jogging and running, said sock comprising a lower sole knit of body yarn and including a heel portion adjacent one end of said sole, an arch area in the medial portion of said sole, and a ball portion adjacent the other end of said sole, said arch area including inner and outer arch portions positioned on opposite sides of said sole and extending coursewise from substantially the middle wale of said sole, said arch area being knit of said body yarn and a first terry yarn forming a first set of terry loops in said heel, ball and said inner and outer arch portions, said heel, ball and inner arch portions including an integrally knit support cushion adapted to underlie the heel, ball and inner arch of the wearer's foot and being knit with a second terry yarn knit with said body yarn and said first terry yarn to form a second set of terry loops in said heel, ball and inner arch portions, said support cushion including a greater terry loop density than the terry loop density in said outer arch portion for enhancing the support and cushioning on the heel, ball and inner arch of the wearer's foot and thereby reducing the shock normally imparted to the heel, ball and inner arch of the wearer's foot so that normal articulation of the bones in the foot takes place during participation in vigorous athletic activities.

6. A sock according to claim 5 wherein said second terry yarn in said ball and said inner arch portion is cut and forms free ends at opposite sides of said inner arch portion.

7. A sock according to claim 6 including an interim area in said lower sole and between said arch and said heel portion, said interim area being knit with said body yarn, said first terry yarn, and said second terry yarn and forming first and second sets of terry loops.

* * * * *

UNITED STATES PATENT AND TRADEMARK OFFICE

CERTIFICATE OF CORRECTION

PATENT NO. : 4,277,959

DATED : July 14, 1981

INVENTOR(S) : James L. Thorneburg

It is certified that error appears in the above-identified patent and that said Letters Patent are hereby corrected as shown below:

Column 1, line 41, after "4,194,249," insert --discloses--.
Column 3, line 19, "tow" should be --toe--.
Column 5, line 30, "and" should be --are--.
Column 5, line 67, "increases" should be --increased--.
Column 6, Claim 1, line 15, "sufffi-" should be --suffi---.
Column 6, Claim 1, line 26, "onegrally" should be --integrally--.

Signed and Sealed this

*Twenty-second* Day of *September 1981*

[SEAL]

*Attest:*

GERALD J. MOSSINGHOFF

*Attesting Officer* *Commissioner of Patents and Trademarks*